United States Patent [19]

Lee

[11] Patent Number: 4,894,008

[45] Date of Patent: Jan. 16, 1990

[54] CANDLE HOLDING DEVICE

[76] Inventor: Sun Lee, 13812 W. 59th Ave., Arvada, Colo. 80004

[21] Appl. No.: 333,436

[22] Filed: Apr. 4, 1989

[51] Int. Cl.[4] ..... F23D 3/16

[52] U.S. Cl. ..... 431/290; 431/291

[58] Field of Search ..... 431/288, 289, 290, 291; 362/161, 163

[56] References Cited

U.S. PATENT DOCUMENTS

| | | | |
|---|---|---|---|
| 136,290 | 2/1873 | Walton et al. | 431/290 |
| 397,011 | 1/1889 | Leynen-Hougaerts | 431/291 |
| 416,418 | 12/1889 | Nessle | 431/290 |
| 663,833 | 12/1900 | MacIvy | 431/290 |
| 760,156 | 5/1904 | Schifferle | 431/290 |
| 2,234,903 | 3/1941 | Muench | 431/288 |
| 2,987,901 | 6/1961 | Coffey | 431/290 |
| 3,240,035 | 3/1966 | Anderson | 431/290 |
| 4,185,953 | 1/1980 | Schirneker | 431/291 |
| 4,524,408 | 6/1985 | Minera | 431/291 X |
| 4,569,655 | 2/1986 | Charette et al. | 431/290 |
| 4,681,534 | 7/1987 | Schenke et al. | 431/290 |

FOREIGN PATENT DOCUMENTS

| | | | |
|---|---|---|---|
| 154344 | 9/1903 | Fed. Rep. of Germany | 431/290 |
| 2053527 | 5/1972 | Fed. Rep. of Germany | 431/290 |
| 12696 | 8/1896 | France | 431/290 |
| 20196 | 1/1917 | France | 431/290 |
| 797429 | 4/1936 | France | 431/290 |
| 18633 | of 1889 | United Kingdom | 431/290 |
| 18959 | of 1894 | United Kingdom | 431/290 |
| 159951 | 3/1921 | United Kingdom | 431/290 |

*Primary Examiner*—Randall L. Green

*Attorney, Agent, or Firm*—Sheridan, Ross & McIntosh

[57] ABSTRACT

A device is provided for containing a candle in liquid having a specific gravity greater than candle wax. The device comprises a reservoir assembly, adapted to hold fluid, operatively associated with a candle guide assembly. The reservoir assembly defines a first hollow cavity and includes first and second openings. The candle guide assembly, which includes one or more communication apertures, is adapted to receive and guide a candle supported by fluid fed through the communication apertures from the reservoir assembly. An outer edge of the candle guide assembly is fixedly mounted adjacent to the second opening such that the candle guide assembly is immovable relative to the reservoir assembly and a section of the candle guide assembly protrudes into the first hollow cavity of the reservoir assembly.

22 Claims, 2 Drawing Sheets

CANDLE HOLDING DEVICE

BACKGROUND OF THE INVENTION

1. Field of the Invention

The present invention relates to a candle holding device of the type in which the candle, as it burns, is displaced by fluid denser than conventional candle wax, and more particularly, to an improved candle holding device of the type incorporating a reservoir-feed system which maintains an upper section of the candle at a constant level throughout the burning process.

2. Background Art

Candle wax is less dense than various liquids, such as water. Consequently, a candle floated along or within a body of water is displaced by the water as the wax is burned. Candles, such as those disclosed in Muench, U.S. Pat. No. 2,234,903, are floated directly on the surface of a water body. The useful life of such candles, however, is limited since the candle height is generally small relative to its length.

A solution to problems typically associated with floating candle holders is taught by Minera U.S. Pat. No. 4,524,408. A preferred embodiment of the Minera candle holder includes an elongate candle positioned within a tubular member having a restricted aperture communicating with a water reservoir. The tubular member is operatively associated with an air-filled structure which effectively maintains a top portion of the tubular member near a surface of the reservoir. The Minera candle holder is suspended, rather than fixedly mounted, within the reservoir by way of the annular air-filled structure. Since the candle holder is not fixed to a bottom or side of the container, it is necessary to employ stabilizing means, such as a heavy metal collar, to prevent the candle holder from tipping over.

Reservoir-feed type candle holding devices represent an alternative to the floating candle arrangements discussed above. In a reservoir-feed type candle holder, the candle is suspended by fluid within a guide tube or sconce. As the candle burns, it is displaced within the guide tube.

For example, Nessle U.S. Pat. No. 416,418 discloses a hydraulic candle stick having a candle disposed within an inner tube encompassed by an outer tube. Fluid is communicated to an annular channel defined between the inner tube and outer tube from a reservoir disposed exterior to the outer tube. Water is fed underneath the candle from the annular channel via a first set of apertures disposed within a bottom section of the inner wall. Water is fed to the annular channel via a second set of apertures disposed within an upper section of the outer wall. In the Nessle hydraulic candlestick, the reservoir does not communicate directly with the inner tube. That is, the inflowing water follows a path from the reservoir, to the inner tube channel via the annular channel.

The MacIvy U.S. Pat. No. 663,833 discloses a candle holder including two reservoirs feeding two candle-holding sconces, respectively. The sconces are positioned below the reservoirs, thus increasing the vertical extent of the candle holding portion. Water is supplied to the reservoirs from overhead via a plurality of apertures or valved tubes.

Reservoir-feed type candle holders, such as those represented by Nessle and MacIvy, possess a construction that is relatively bulky and a design that is overly complex. Accordingly, it would be difficult to effectively manufacture and market the Nessle and MacIvy holders on a large scale. With an ever-increasing demand for candle holding devices, there is a need for a candle holder that is designed with a concern for simplicity and efficiency, as well as compactness and convenient maintenance.

SUMMARY OF THE INVENTION

The present invention is embodied in a device for containing a candle within a fluid having a specific gravity greater than candle wax. The device comprises a reservoir assembly, adapted to hold fluid, operatively associated with a candle guide assembly. The reservoir assembly defines a first hollow cavity, and has first and second openings. The candle guide assembly, which is adapted to receive and guide the candle, defines a second hollow cavity and has a third opening. An outer edge of the candle guide assembly is fixedly mounted adjacent to the reservoir assembly second opening such that the candle guide assembly is immovable relative to the reservoir assembly and a section of the candle guide assembly protrudes into the first hollow cavity of the reservoir assembly. In the preferred embodiment, communication apertures for receiving a portion of the fluid deposited in the first hollow cavity are disposed along the length of the section protruding into the first hollow cavity, and the communication apertures are spaced from a point proximate to the third opening. Consequently, the fluid moves directly from the first hollow cavity into the second hollow cavity and the candle is supported by the fluid communicated into the second hollow cavity.

In another aspect of the invention, a protective shield is operatively associated with a section of the candle guide assembly to prevent substantially any splashinq of liquid out of the device. Additionally, the protective shield serves to minimize wetting of the burning wick or molten wax, during operation, which might extinguish the flame. The protective shield is a member disposed adjacent to the third opening and extending laterally therefrom. An edge of the member is spaced from the third opening, and disposed adjacent to an inner surface of the reservoir assembly such that splashing is minimized as the device is transported from one location to another. An aperture is preferably disposed within the protective shield to facilitate decanting of the fluid through the first opening of the reservoir assembly and prevent the formation of any air cavities underneath the protective shield.

In yet another aspect of the candle holding device, an evacuating mechanism is provided near a bottom section of the candle guide assembly. In this example of the device, the candle guide assembly includes a fourth opening, i.e., an evacuation opening which during normal use is covered by a conventional cap. The device is provided with a base so that when the device is set along a flat surface, the evacuation opening and cap are elevated relative thereto. By providing evacuation through a bottom section, liquid and candle debris can be efficiently and effectively removed.

The principal advantages of the invention are to provide a candle holding device which is structurally uncomplicated and efficient in operation. The device is optimally streamlined and can be maintained with particular ease. More specifically, due to the device's simple, yet effective design, it can be maintenanced with a minimum amount of disassembly. For example, total release of fluid and candle debris is possible without tipping the device over. Moreover, the device can be adapted to accommodate for those situations in which it is desirable to transport the liquid-filled reservoir assembly from one location to another. Since, during use, the candle is always enclosed within the reservoir assembly, safety of the device is maximized. Ease of manufacturing results in cost reductions.

These and other features, advantages and objects of the present invention will be further understood and appreciated by those skilled in the art by reference to the following specification, claims and drawings appended hereto.

DETAILED DESCRIPTION OF THE PREFERRED EMBODIMENTS

Figure 3:
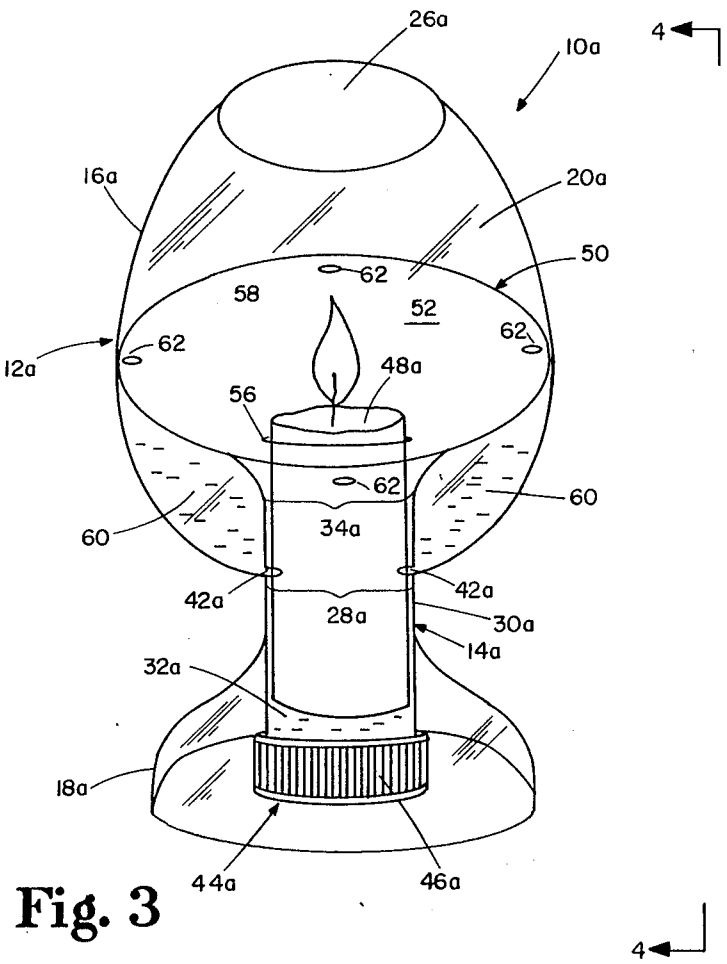
FIG. 3 is a perspective view of another preferred embodiment of the candle holding device including a splash guard assembly.

For purposes of description herein, the terms "upper", "lower", "right", "left", "rear", "front", "vertical", "horizontal" and derivatives thereof shall relate to the invention as oriented in the drawings attached herewith. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions, and other physical characteristics relating to the embodiments disclosed herein are not to be considered as limiting, unless the claims by their language expressly state otherwise.

Figure 1:
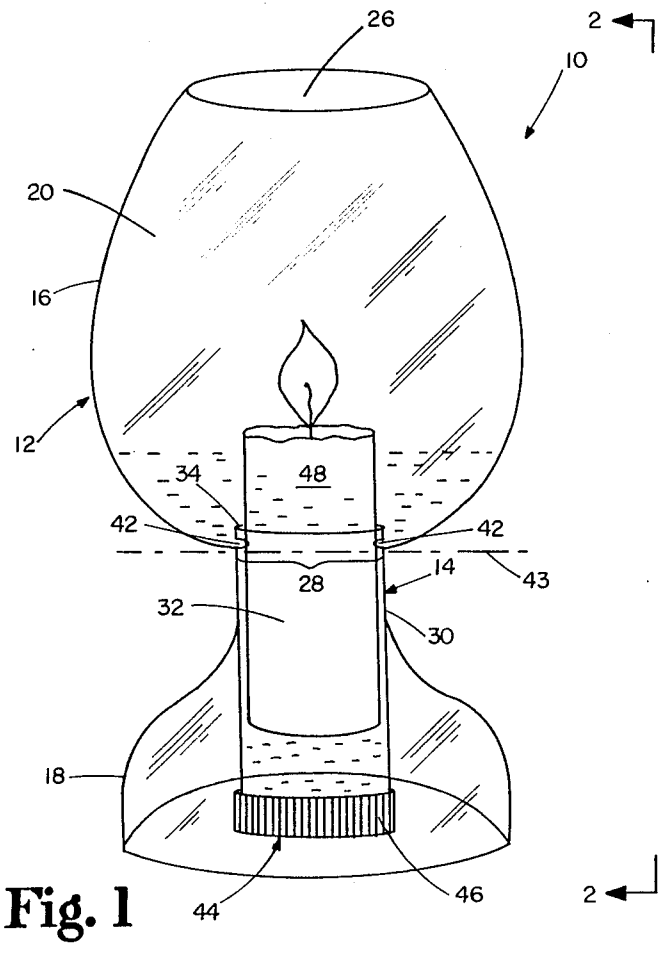
FIG. 1 is a perspective view of a candle holding device involving the present invention.
Figure 2:
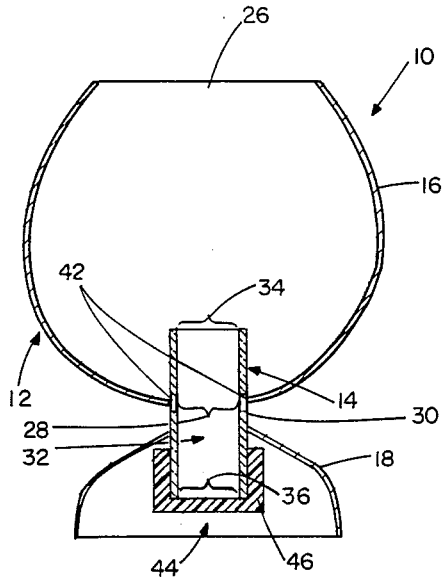
FIG. 2 is a vertical cross-sectional view of the candle holding device taken along plane 2—2 in FIG. 1.

Referring now to the drawings in greater detail wherein like reference numerals indicate like parts throughout the several figures, the reference numeral 10 (FIGS. 1 and 2) generally indicates a candle holding device embodying the present invention. Candle holding device 10 includes a reservoir assembly 12 and a candle guide assembly 14. The reservoir assembly 12 is divided into a reservoir container 16 and a base 18. The reservoir container 16 defines a first hollow cavity 20 and has a first opening 26 and second opening 28. As best illustrated in FIG. 1, candle guide assembly 14 is closely received within opening 28 and is fixedly mounted therein such that the candle guide assembly 14 is immovable relative to reservoir assembly 12. In one example, reservoir assembly 12 and candle guide assembly 14 are integrally formed.

In the present example, reservoir container 16 is spherically shaped and the shape of candle guide assembly 14 conforms with that of a typical elongate candle. In other embodiments, the shapes and dimensions of candle guide assembly 14 and reservoir container 16 could be varied to accommodate for other candle shapes and sizes. Additionally, reservoir assembly 12 and candle guide assembly 14 are constructed of glass to facilitate viewing of the candle burning process It can be appreciated that the various elements of the candle holding device 10 may be constructed of materials different than those used in the preferred embodiment of the candle holding device 10 without departing from the scope of the present invention., Candle guide assembly 14, which has a guide container 30 defining a second hollow cavity 32 includes third opening 34 and fourth opening 36. Additionally, candle guide assembly 14 includes communication apertures 42, through which fluid is communicated from reservoir container 16. In the preferred embodiment communication apertures 42 are positioned above a plane 43 coextensive with second opening 28. In one example (FIGS. 1 and 2), fluid is fed into second hollow cavity 32 exclusively by use of communication apertures 42. It should be appreciated that candle holding device 10 could be adapted to employ more than one of candle guide assembly 14. That is two or more candle guide assemblies could be positioned in an appropriately sized opening 28.

In the preferred embodiment, candle holding device 10 is supported along a bottom section thereof by the base 18. While in the present example, base 18 is substantially hollow, in other embodiments it could be substantially solid. Additionally, base 18 could be enclosed along its bottom portion, thus eliminating the need to enclose fourth opening 36. Candle guide assembly 14 is provided with an evacuation mechanism 44. One embodiment of the evacuation mechanism 44 is effected by making a portion of base 18 hollow and covering fourth opening 36 with a cap 46. Additionally, as illustrated in either of FIGS. 2 and 4, threads may be etched on both an outer surface of guide container 30 and an inner surface of cap 46 so that fourth opening 36 can be selectively closed by way of a screw fitting. It should be appreciated, however, that the covering function could be effected with a frictional fitting instead of a screw fitting. For example, a stopper or a stretchable membrane could also be employed to close fourth opening 36.

In operation, fluid, preferably water, is poured into reservoir container 16 via first opening 26. A candle 48 may be positioned in the guide container 30 before or after pouring the fluid into the reservoir container 16. As the fluid is poured into first hollow cavity 20, it is communicated to second hollow cavity 32 by way of communication apertures 42. Initially, all of the fluid is fed into second hollow cavity 32 until the fluid level reaches the height at which communication apertures 42 are located. Thereafter, as fluid is poured into first hollow cavity 20, the fluid level in first hollow cavity 20 and second hollow cavity 32 rise at the same rate.

The desired final fluid level may be varied since operation of device 10 is not impaired when an upper portion of candle 48 protrudes out of guide container 30. It is, of course, undesirable to have a substantial amount of candle 48 protruding out of guide container 30 since candle 48 can tip over if, at any time during use, a sufficient portion of candle 48 is not supported within guide container 30. As should be appreciated, due to displacement of candle 48 by the fluid, a top portion of candle 48 is constantly maintained along the fluid level.

As is common with reservoir feed type candle holders, as wax is dissipated from the burning candle 48, the candle 48 is displaced by liquid flowing into second hollow cavity 32 via communication apertures 42. This provides the advantageous result of avoiding scum buildup within candle holding device 10. Nonetheless, it is desirable to remove a candle stub after each use. In one example, both of the fluid and stub may be removed from device 10 by simply tipping candle holding device 10 over, removing the stub, and allowing the fluid to drain by way of first opening 26. Tipping of device 10 can, however, create unwanted mess. In any event, the fluid and stub are optimally removed by allowing for drainage through evacuation mechanism 44. To use evacuation mechanism 44, candle holding device 10 is positioned over an appropriate drain area and cap 46 is removed so that the fluid along with the stub are quickly and efficiently released.

While candle holding device 10, as illustrated in FIG. 1, provides optimal results as a reservoir feed type candle holder, it is inconvenient to transport from one location to another when any significant amount of fluid is deposited in first hollow cavity 20 and second hollow cavity 32. More specifically, as candle holding device 10 is transported, liquid can slosh back and forth within device 10 and splash over the edge defined by first opening 26. Problems associated with splashing are easily remedied by use of a splash guard mechanism 50 (FIGS. 3 and 4) in another preferred embodiment, namely candle holding device 10*a*. As will be recognized, candle holding device 10*a* is constructed and operated in a fashion similar to previously described candle holding device 10. Therefore, common elements of candle holding device 10*a* are given reference numerals similar to the reference numerals of candle holding device 10, with the exception of the addition of a suffix "a".

Figure 4:
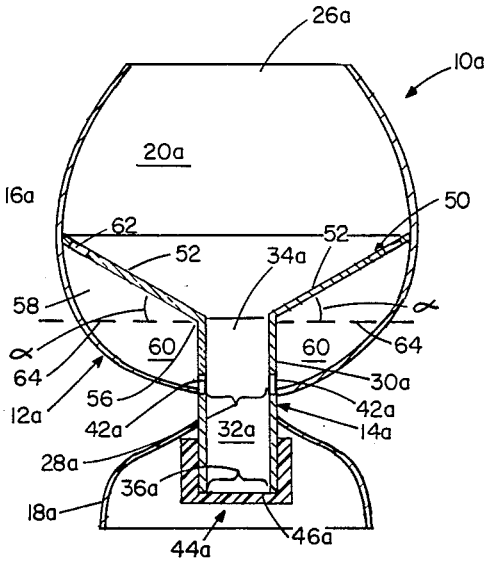
FIG. 4 is a vertical cross-sectional view of the candle holding device taken along plane 4—4 in FIG. 3.

In the preferred embodiment, splash guard mechanism 50 includes a frusto-conically shaped member 52 having a first edge 56 and second edge 58. As best illustrated in FIGS. 3 and 4, first edge 56 is attached to guide container 30*a* near third opening 34*a*. Member 52 extends laterally away from third opening 34*a* such that second edge 58 is disposed adjacent to an inner surface of reservoir container 16*a*. A third hollow cavity 60 is formed within device 10*a* by an outer surface of guide container 30*a* an inner surface of reservoir container 16*a* and an outer surface of member 52. Splash guard 50 further includes at least one vent aperture 62, the significance of which will be discussed in further detail below.

The candle holding device 10*a* of FIG. 3 is used much in the same way as the candle holding device 10 of FIG. 1. Fluid is deposited in first hollow cavity 20*a* and second hollow cavity 32*a* until the fluid level reaches an appropriate height. As explained above, the height of the fluid level may exceed the height of guide container 30*a* without impairing the function of candle holding device 10*a*. It is desirable, nonetheless, that the fluid level be maintained below second edge 58 (FIG. 4) so that sloshing is contained by the member 52. Containment of sloshing is further facilitated by increasing the angularity of member 52 relative to horizontal plane 64. As illustrated in FIG. 4, angularity of member 52 with respect to horizontal plane 64 is defined as alpha. By increasing alpha the function of splash guard 50 is enhanced and splashing is further minimized. Experimentation indicates that angle alpha is optimized when alpha is between about 50°–60°.

Without using at least one vent aperture 62, third hollow cavity 60 cannot be completely filled with fluid. That is, without a vent, as the fluid level exceeds the level of horizontal plane 64, air pockets form below member 52 within third hollow cavity 60. Addition of at least one vent aperture 62 within member 52 eliminates this problem since an escape route is provided for the trapped air, i.e. when vent aperture 62 is present, the trapped air can be replaced by the water. As illustrated in FIG. 3, more than one vent aperture 62 is employed in the preferred embodiment. Positioning of vent apertures 62 near second edge 58 allows for substantial filling of third hollow cavity 60. Vent apertures 62 also facilitate decanting of the liquid when device 10 is tipped over so that the fluid can easily drain out of first opening 26*a*. As will be appreciated by those skilled in the art, it is difficult to completely decant the fluid through first opening 26*a* when improper venting is provided. Moreover, use of vent apertures 62 allows for total release of fluid trapped within third hollow cavity 60.

Figure 5:
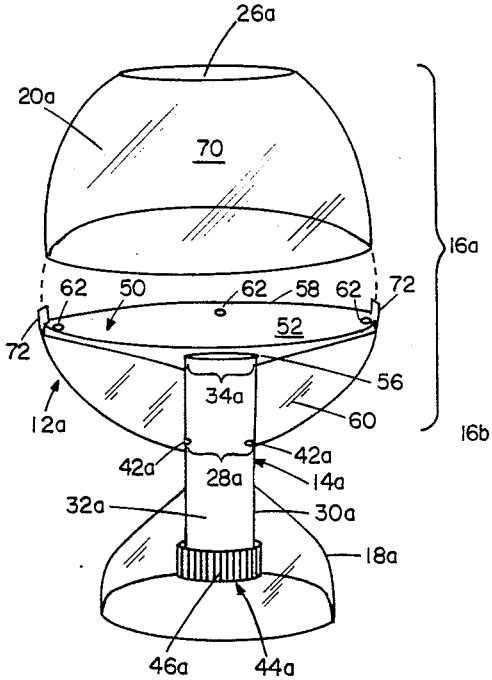
FIG. 5 is a perspective view of the candle holding device of FIG. 3 in which a section of the device is removable.

As illustrated in FIGS. 3 and 4, candle holding device 10*a*, like candle holding device 10, advantageously uses evacuation mechanism 44*a* to access candle guide assembly 14. Alternatively candle holding device 10*a* may be adapted (FIG. 5) to provide access to candle guide assembly 14*a* from above. For example, reservoir container 16*a* is partitioned near second edge 58 of splash guard mechanism 50 to form container section 70 and receiving tabs 72 are provided along second edge 58. Container section 70 mates with tabs 72 such that container section 70 is received by tabs 72 and can be removably attached thereto. Alternatively, container section 70 could be mated or seated within a bottom section of reservoir container 16*b* without use of tabs 72. As should be appreciated, use of container section 70 in conjunction with receiving tabs 72 affords a convenient arrangement by which candle debris can be periodically removed.

Figure 6:
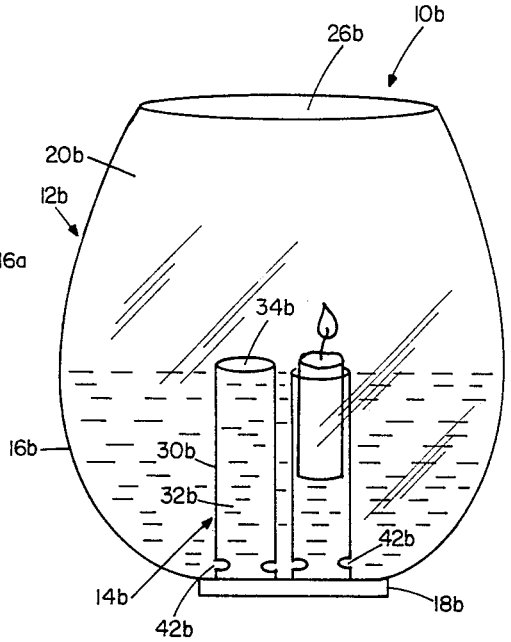
FIG. 6 is a perspective view of yet another preferred embodiment of the candle holding device.

Referring now to FIG. 6, another preferred embodiment of the candle holding device is designated by the numeral 10*b*. As will be recognized, candle holding device 10*b* is constructed and operated in fashion similar to previously described candle holding device 10. Therefore, common elements of candle holding device 10*b* is constructed and operated in a fashion similar to previously described candle holding device 10. Therefore, common elements of candle holding device 10*b* are given reference numerals similar to the reference numerals of candle holding device 10 with the exception of the addition of a suffix "b".

Candle holding device 10*b* comprises a reservoir assembly 12*b* and guide assemblies 14*b*. The reservoir assembly 12*b* is divided into a reservoir container 16*b* and base 18*b*. The reservoir container 16*b* defines a first hollow cavity 20*b* and has a first opening 26*b*. In the present embodiment, reservoir container 16*b* is closed along its bottom section.

Each of candle guide assemblies 14*b*, which has a guide container 30*b* defining a second hollow cavity 32*b*, includes a second opening 34*b*. Even though two candle guide assemblies 14*b* are shown in FIG. 6, as should be appreciated by those skilled in the art, candle holding device 10*b* can be constructed with one or more candle guide assemblies 14*b*. Additionally, each of candle guide assemblies 14*b* includes communication apertures 42*b* through which fluid is communicated from reservoir container 16*b*. In the preferred embodiment, communication apertures 42b are positioned in the lower half of each of guide containers 30b; however, communication apertures 42b could be positioned along the upper half of each of guide containers 30b as long as a sufficient amount of fluid is deposited in first hollow cavity 20b to appropriately fill each of second hollow cavities 32b. In the present example, fluid is fed exclusively to each of second hollow cavities 32b by way of communication apertures 42b. It should be appreciated that as with candle holding device 10a, a splash guard mechanism (not shown) could be provided near openings 34b surrounding edges of guide containers 30b to prevent sloshing of fluid from within guide container 16b.

Operation of candle holding device 10b is, for all intents and purposes, the same as that for candle holding device 10. Of course, as liquid is poured into hollow cavity 20b of reservoir container 16b, the water levels within reservoir container 16b and guide containers 30b rise simultaneously. To dispose of candle debris remaining after a candle has been burned, candle holding device 10b is simply tipped over an appropriate drain so that the fluid and debris can be dispensed therefrom.

As should be appreciated by those skilled in the art, candle guide assemblies 14b are advantageously fixed to a floor portion of reservoir container 16b via conventional interconnections. In the preferred embodiment, reservoir container 16b and guide containers 30b are constructed of glass and the above-mentioned interconnections are effected by known soldering techniques. When using other materials, such as plastics, use of other types of known interconnections, such as ultrasonic interconnections, would be appropriate. Additionally, since guide containers 30b are affixed to the floor of reservoir container 16b stability of candle guide assemblies 14b is maximized such that, upon accidential jarring of candle holding device 10b, none of candle guide assemblies 14b are not tipped over. Finally, each of candle guide assemblies 14b is a singular unit which is preferably integral with reservoir container 16b. Thus, candle holding device 10b is easy to manufacture, facilitating cost reductions.

Due to the construction of the candle holding device, it is efficient in function and exceedingly simple to manufacture, resulting in cost reductions. The candle holding device represents advancements in reservoir-feed type candle holders that have not heretofore been recognized. The simplicity of design facilitates convenience while promoting safety. Use of an evacuation mechanism provides for quick and complete release of all fluid and any remaining candle debris from the device. In those situations in which it is desirable to transport the fluid-filled device, a splash guard, for minimizing fluid sloshing, can be provided.

In the foregoing description, it will be readily appreciated by those skilled in the art that modifications may be made to the invention without departing from the concepts disclosed herein. Such modifications are to be considered as included in the following claims unless these claims by their language expressly state otherwise.

The embodiments of the invention in which an exclusive property or privilege is claimed are defined as follows:

1. A device for holding a candle using fluid, comprising:

a first container defining a first hollow cavity, said first container having first and second openings;

at least one second container being adapted to receive and guide the candle and for holding fluid, said second container defining a second hollow cavity and having a third opening, an outer edge of said second container being fixedly mounted to said first container adjacent to said second opening, wherein said second container is immovable relative to said first container and a section of said second container protrudes into said first hollow cavity of said first container;

wherein said second container includes means for communicating a portion of the fluid held in said first hollow cavity into said second hollow cavity, and wherein the fluid moves directly from the first hollow cavity into said second hollow cavity and the candle is supported by the fluid communicated into said second hollow cavity;

means for supporting connected to one of said first container and said second container; and wherein said means for supporting includes a base having a hollow section and a bottom section of said second container is readily accessed via said hollow section.

2. A device for holding a candle using fluid comprising:

a first container defining a first hollow cavity, said first container having first and second openings;

at least one second container being adapted to receive and guide the candle and for holding fluid, said second container defining a second hollow cavity and having a third opening, an outer edge of said second container being fixedly mounted to said first container adjacent to said second opening, wherein said second container is immovable relative to said first container and a section of said second container protrudes into said first hollow cavity of said first container;

wherein said second container includes means for communicating a portion of the fluid held in said first hollow cavity into said second hollow cavity, and wherein the fluid moves directly from the first hollow cavity into said second hollow cavity and the candle is supported by the fluid communicated into said second hollow cavity;

means for supporting connected to one of said first container and said second container; and means for evacuating substantially all of the fluid deposited in the device, said means for evacuating being disposed proximate to a bottom section of said second container.

3. The device of claim 2, wherein said evacuating means includes:

a fourth opening defined within said second container;

means for selectively covering said fourth opening.

4. The device of claim 3, wherein:

both of an outer surface of said bottom section of said second container and an inner surface of said means for selectively covering are threaded wherein said means against said outer surface of said bottom section.

5. The device of claim 3, wherein said means for selectively covering is adapted to be frictionally fitted against a surface of said second container.

6. A device for holding a candle using fluid comprising:

a first container defining a first hollow cavity, said first container having first and second openings;

at least one second container being adapted to receive and guide the candle and for holding fluid, said second container defining a second hollow cavity and having a third opening, an outer edge of said second container being fixedly mounted to said first container adjacent to said second opening, wherein said second container is immovable relative to said first container and a section of said second container protrudes into said first hollow cavity of said first container;

wherein said second container includes means for communicating a portion of the fluid held in said first hollow cavity into said second hollow cavity, and wherein the fluid moves directly from the first hollow cavity into said second hollow cavity and the candle is supported by the fluid communicated into said second hollow cavity; and means for preventing substantially any splashing of the fluid out of the device, said means for preventing being disposed within said first hollow cavity wherein when the fluid is maintained at a predetermined level the same is substantially contained within the device by said means for preventing as the device is transported from one location to another.

7. The device of claim 6, wherein said means for preventing includes:

a member disposed adjacent to and extending laterally away from said third opening, said member having an edge disposed adjacent to an inner surface of said first container wherein a third hollow cavity is defined between surfaces of said member, said first container and said second container.

8. The device of claim 7, wherein:

said member is angled relative to a horizontal plane.

9. The device of claim 7, wherein at least one aperture is defined within said member to facilitate both distribution of fluid within said third hollow cavity and decanting of the fluid when the device is overturned.

10. A device for holding a candle using fluid, comprising:

a first container defining a first hollow cavity, said first container having first and second openings;

at least one second container being adapted to receive and guide the candle and for holding fluid, said second container defining a second hollow cavity and having a third opening, an outer edge of said second container being fixedly mounted to said first container adjacent to said second opening, wherein said second container is immovable relative to said first container and a section of said second container protrudes into said first hollow cavity of said first container;

wherein said second container includes means for communicating a portion of the fluid held in said first hollow cavity into said second hollow cavity, and wherein the fluid moves directly from the first hollow cavity into said second hollow cavity and the candle is supported by the fluid communicated into said second hollow cavity; and wherein said candle holding device includes a plurality of second containers, each of which is fixedly mounted to said first container adjacent said second opening.

11. A device for holding a candle using fluid, comprising:

a first container defining a first hollow cavity, said first container having first and second openings;

at least one second container being adapted to receive and guide the candle and for holding fluid, said second container defining a second hollow cavity and having a third opening, an outer edge of said second container being fixedly mounted to said first container adjacent to said second opening, wherein said second container is immovable relative to said first container and a section of said second container protrudes into said first hollow cavity of said first container; and means for preventing substantially any splashing of the fluid out of the device, said means for preventing being positioned within said first hollow cavity wherein when the fluid is maintained at a predetermined level the same is substantially contained by said means for preventing as the device is transported from one location to another.

12. The device of claim 11, wherein:

said candle holding device includes a plurality of second containers, each of which is fixedly mounted to said first container adjacent said second opening.

13. The device of claim 11, wherein:

said first container is partitioned wherein a section of said first container is removable such that candle debris can be periodically removed from said second container.

14. A device for holding a candle using fluid, comprising:

a first container defining a first hollow cavity, said first container having first and second openings;

at least one second container being adapted to receive and guide the candle and for holding fluid, said second container defining a second hollow cavity and having a third opening, an outer edge of said second container being fixedly mounted to said first container adjacent to said second opening, wherein said second container is immovable relative to said first container and a section of said second container protrudes into said first hollow cavity of said first container; and means for evacuating substantially all of the fluid deposited in the device, said means for evacuating being disposed proximate to a bottom section of said second container.

15. The device of claim 14, wherein said means for evacuating includes:

a fourth opening defined within said second container; and means for selectively covering said fourth opening.

16. The device of claim 14, wherein:

said candle holding device includes a plurality of second containers, each of which is fixedly mounted to said first container adjacent said second opening.

17. The device of claim 14, further comprising:

means for supporting the device connected to one of said first container and said second container.

18. The device of claim 17, wherein:

said means for supporting the device includes a base having a hollow section wherein a bottom section of said second container, and hence said means for evacuating, is readily accessed.

19. A device for holding a candle using fluid, comprising:

a first container defining a first hollow cavity, said first container having at least one opening;

at least one second container, said second container defining a second hollow cavity and a second opening;

interconnecting means for fixedly securing one end of said second container to a floor of said first container wherein said second container is immovable relative to said first container;

wherein said second container includes means for communicating a portion of the fluid held in said first hollow cavity into said second hollow cavity, and wherein the fluid moves directly from the first hollow cavity into said second hollow cavity and the candle is supported by the fluid communicated into said second hollow cavity; and means for preventing substantially any splashing of the fluid out of the device, said means for preventing being disposed within said first hollow cavity wherein when the fluid is maintained at a predetermined level the same is substantially contained within the device by said means for preventing as the device is transported from one location to another.

20. A device for holding a candle using fluid, comprising:

a first container defining a first hollow cavity, said first container having at least one opening;

at least one second container, said second container defining a second hollow cavity and a second opening;

interconnecting means for fixedly securing one end of said second container to a floor of said first container wherein said second container is immovable relative to said first container; and wherein said second container includes means for communicating a portion of the fluid held in said first hollow cavity into said second hollow cavity, and wherein the fluid moves directly from the first hollow cavity into said second hollow cavity and the candle is supported by the fluid communicated into said second hollow cavity and wherein said candle holding device includes a plurality of second containers, each of which is fixedly mounted to said first container adjacent said floor of said first container.

21. A device for holding a candle using fluid, comprising:

a first container defining a first hollow cavity, said first container having at least one opening;

at least one second container, said second container defining a second hollow cavity and a second opening;

interconnecting means for fixedly securing one end of said second container to a floor of said first container wherein said second container is immovable relative to said first container; and wherein said second container includes means for communicating a portion of the fluid held in said first hollow cavity into said second hollow cavity, and wherein the fluid moves directly from the first hollow cavity into said second hollow cavity and the candle is supported by the fluid communicated into said second hollow cavity and wherein said first container and said second container are integrally formed.

22. A device for holding a candle having a wick, said device using fluid, comprising:

a first container defining a first hollow cavity, said first container having first and second openings;

at least one second container being adapted to receive and guide the candle and for holding fluid, said second container defining a second hollow cavity and having a third opening, an outer edge of second container being fixedly mounted to said first container adjacent to said second opening, wherein said second container is immovable relative to said first container and a section of said second container protrudes into said first hollow cavity of said first container; and wherein said second container includes means for communicating a portion of the fluid held in said first hollow cavity into said second hollow cavity, said means for communicating being disposed along the length of said section protruding into said first hollow cavity, said means for communicating being spaced from said third opening and being located at a position along the length of said protruding section to effectively allow for the continuous flow of fluid into said second hollow cavity throughout the entire interval in which the candle is burned, wherein the fluid moves directly from said first hollow cavity into said second hollow cavity and the candle is supported by the fluid communicated into said second hollow cavity, wherein the candle is free-floating within said second hollow cavity and substantially all of a bottom portion of the candle is contacted by the fluid, and wherein, during operation, an uppermost portion of the candle wick is maintained at a level that is one of: substantially coplanar with said third opening and spaced above said third opening; and hollow base means for supporting said second container, said base means being fixedly attached to a portion of said second container and said second container extending into said hollow base means.

* * * * *